US006546586B2

(12) United States Patent
Cho

(10) Patent No.: US 6,546,586 B2
(45) Date of Patent: Apr. 15, 2003

(54) TOOTHBRUSH WITH FLOSSING FUNCTIONALITY

(76) Inventor: Spencer Y. Cho, P.O. Box 5357, Lancaster, CA (US) 93539-5357

( * ) Notice: Subject to any disclaimer, the term of this patent is extended or adjusted under 35 U.S.C. 154(b) by 148 days.

(21) Appl. No.: 09/846,540

(22) Filed: May 2, 2001

(65) Prior Publication Data

US 2002/0162183 A1 Nov. 7, 2002

(51) Int. Cl.[7] ..... A46B 9/04
(52) U.S. Cl. ..... 15/167.1; 15/DIG. 5
(58) Field of Search ..... 15/DIG. 5, 167.1, 15/159.1, 160

(56) References Cited

U.S. PATENT DOCUMENTS 2,622,259 A * 12/1952 Chauvin
3,103,679 A * 9/1963 Clemens
4,882,803 A * 11/1989 Rogers
5,249,327 A * 10/1993 Hing
5,392,483 A 2/1995 Heinzelman et al.
5,398,367 A 3/1995 Lu
5,511,275 A 4/1996 Volpenhein et al.
5,535,474 A 7/1996 Salazar
5,732,433 A 3/1998 Gocking et al.
5,926,897 A * 7/1999 Volpenhein
6,021,541 A 2/2000 Mori et al.
D425,306 S 5/2000 Beals et al.
6,178,583 B1 * 1/2001 Volpenhein

* cited by examiner

*Primary Examiner*—Randall E. Chin
(74) *Attorney, Agent, or Firm*—Norman Rainer

(57) ABSTRACT

A toothbrush having an elongated resilient handle has a brush head containing a plurality of tufts of bristles fabricated of polybutylene terephthalate. Each tuft has a multiplicity of short primary bristles and longer secondary bristles having tapered and pointed distal extremities. The effect of the secondary bristles is to function in a manner similar to dental floss to clean the spaces between the teeth.

16 Claims, 3 Drawing Sheets

TOOTHBRUSH WITH FLOSSING FUNCTIONALITY

BACKGROUND OF THE INVENTION

1. Field of the Invention

This invention concerns toothbrushes, and more particularly relates to a toothbrush having a set of bristles for cleaning the teeth and a second set of bristles for cleaning the spaces between the teeth, and under the gumline.

2. Description of the Prior Art

The fundamental purpose of toothbrushes is to remove plaque and debris from the tooth surfaces, both along their outer surfaces and in the interproximal areas as well as provide gum and interdental stimulation. There is a continuing need to improve the interproximal cleaning effectiveness of toothbrushes, particularly because many consumers do not floss.

Currently marketed toothbrushes are classified into three categories: soft, medium and firm according to the degree of hardness or stiffness of the bristles. Firm toothbrushes, having stiff bristles, clean plaque well but irritate the gums. Soft toothbrushes are unable to provide adequate cleaning in the interproximal areas between the teeth. Medium toothbrushes cannot meet all three needs because some teeth need harder cleaning, others need minor cleaning, while the gums need just a massaging.

U.S. Pat. No. 6,021,541 to Mori et. al. describes a toothbrush intended to provide improved cleaning of interdental regions, and comprised of sheath/core bristles wherein the sheath is made from a polyester resin and the core is made from a polyamide resin. Bristles having tapered distal tip extremities are also disclosed.

U.S. Pat. No. 5,732,433 to Gocking et. al. discloses an interproximal brush for an electric toothbrush. The brush has bristles of two different heights, the longer length bristles providing interproximal cleaning function.

U.S. Pat. No. 5,398,367 to Lu concerns a toothbrush having both soft and hard bristles. The soft bristles are longer than the hard bristles, and provide a gum massaging effect. The variation in hardness of the bristles is accomplished by varying the diameter of the bristles.

U.S. Pat. No. 5,392,483 to Henizelman et. al. discloses a toothbrush for improved cleaning, gum stimulation and mouth feel, having varying bristle tuft heights, angling of the tufts, and critical positional arrangement of the tufts.

U.S. Pat. No. 5,511,275 to Volpenhein et. al. describes a toothbrush for achieving improved interproximal cleaning without increasing gum irritation. The ends of the bristles are rounded and have a critically selected stiffness.

U.S. Pat. No. 5,535,474 to Salazar concerns a toothbrush for cleaning teeth while simulating the gums, said toothbrush having polishing rods and stimulator rods that extend above surrounding bristles.

U.S. Pat. No. 5,926,897 to Volpenhein discloses a toothbrush for interdental stimulation comprised of a plurality of tufts having a multiplicity of primary and secondary bristles, said secondary bristles being stiffer than said primary bristles and extending above said primary bristles.

However, despite considerable prior effort, there still exists a need for a toothbrush having the ability to clean the teeth while providing the benefits of flossing. Some of the aforesaid prior toothbrushes, although having technical merit, would be expensive to manufacture.

It is accordingly a primary object of the present invention to provide a toothbrush which serves well in cleaning teeth and also provides the benefits of flossing.

It is another object of this invention to provide a toothbrush as in the foregoing object which will not irritate the gums.

It is a further object of the present invention to provide a toothbrush of the aforesaid nature which is easy to manipulate during the brushing activity.

It is a still further object of this invention to provide a toothbrush of the aforesaid nature of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a toothbrush comprising an elongated resilient handle extending between two ends and a brush head disposed at one of said ends, said brush head having a flat support surface and a plurality of tufts of bristles fabricated of polybutylene terephthalate, each tuft comprised of:

a) a multiplicity of primary bristles of uniform cross-sectional configuration having proximal ends embedded in said head and distal ends extending orthogonally outward from said support surface, and b) a multiplicity of secondary bristles having proximal extremities embedded in said head and pointed distal extremities extending orthogonally outward from said support surface to an action zone beyond the distal ends of said primary bristles, said secondary bristles having a tapered cross-sectional configuration in said action zone that terminates in said pointed distal extremity.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
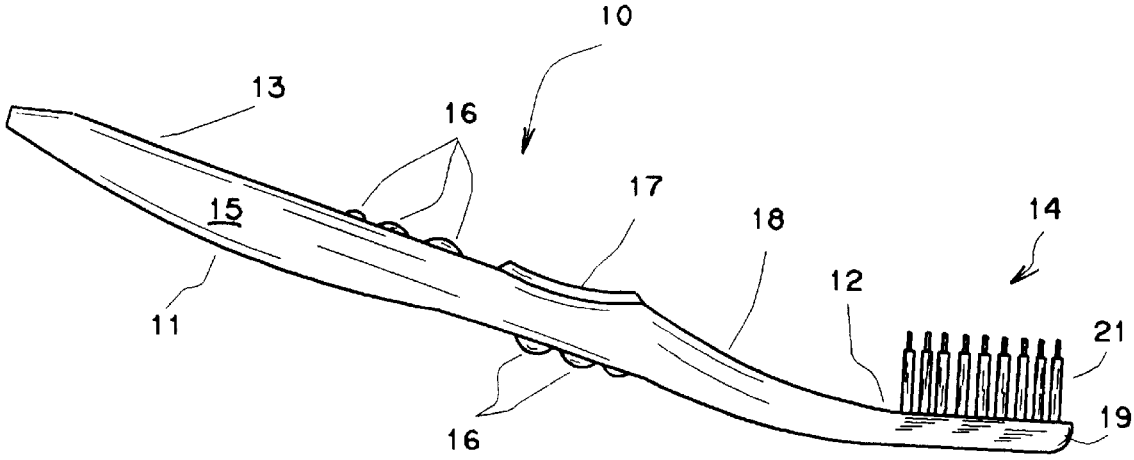
FIG. 1 is a side view of a preferred embodiment of the toothbrush of the present invention.
Figure 2:
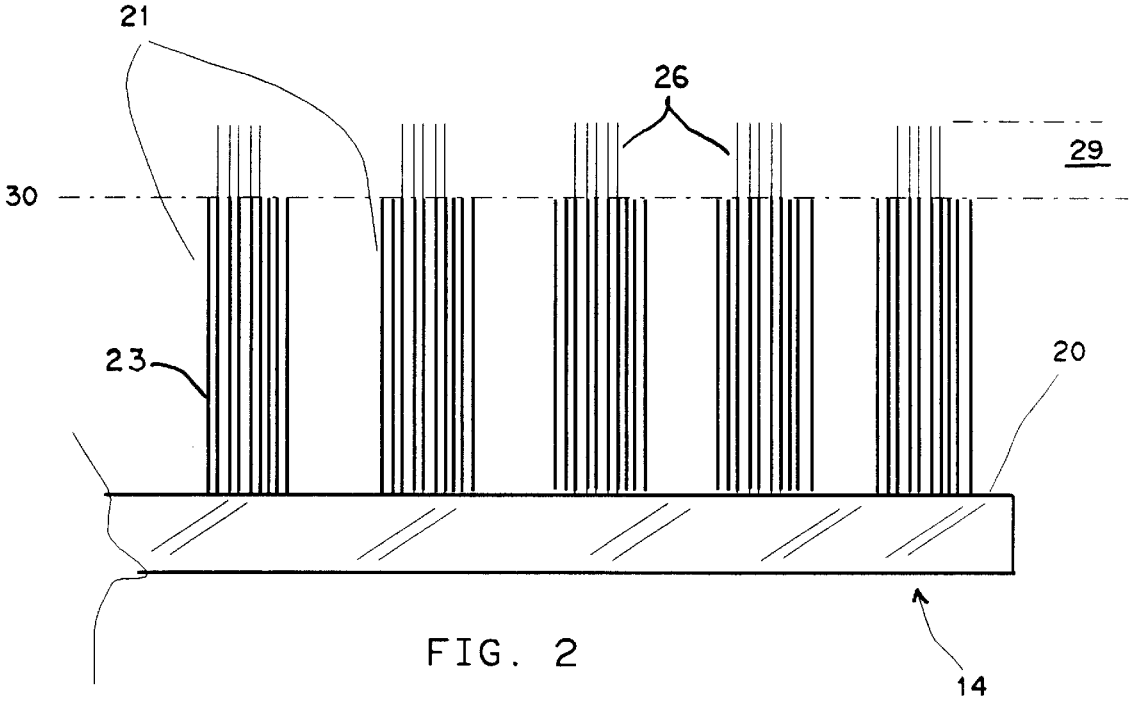
FIG. 2 is an enlarged fragmentary side view showing the head extremity of the toothbrush of FIG. 1.
Figure 3:
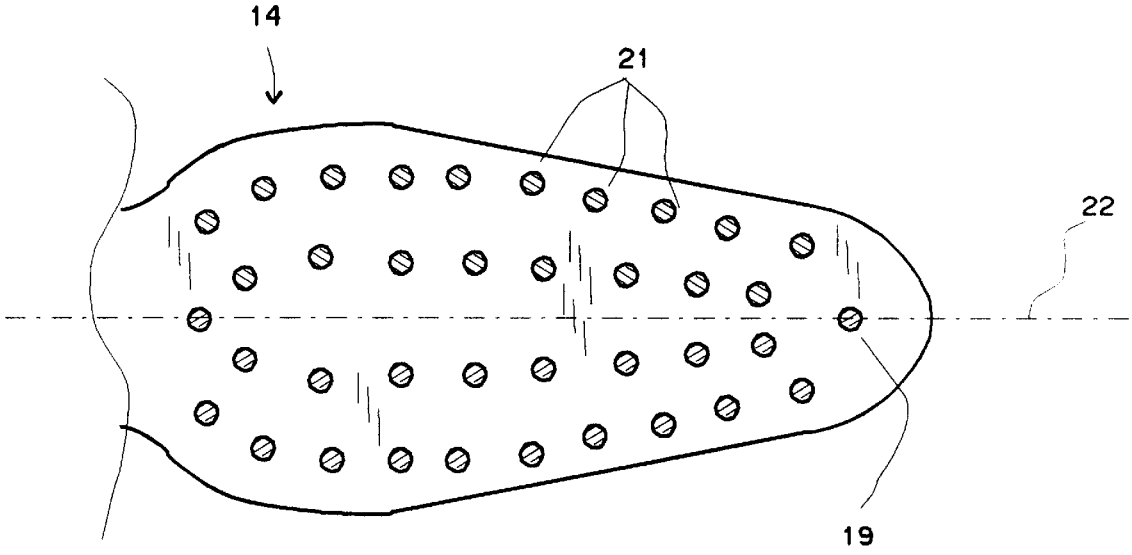
FIG. 3 is a top view of the head extremity shown in FIG. 2.
Figure 4:
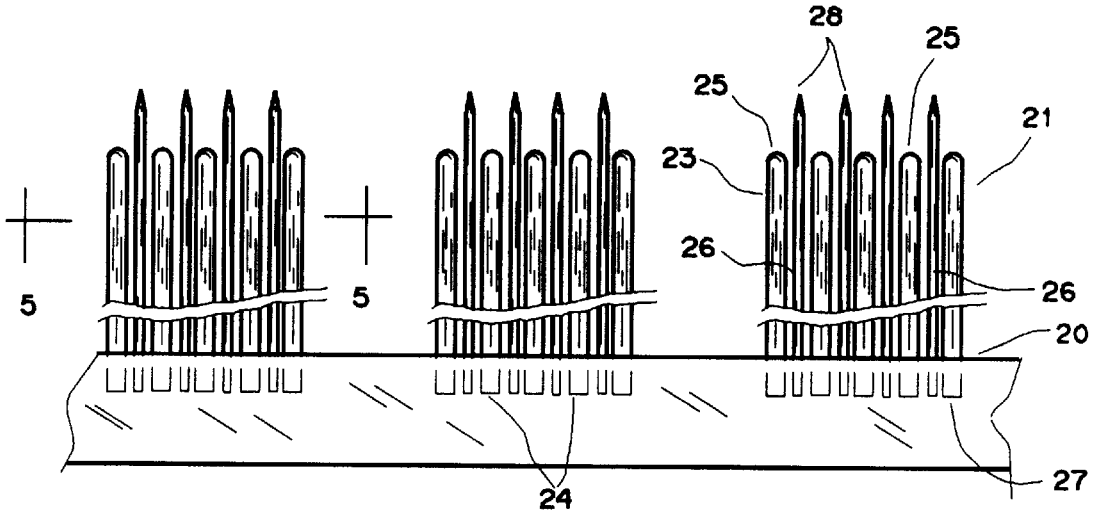
FIG. 4 is a further enlarged fragmentary side view of tufts of the toothbrush shown in FIG. 2.
Figure 5:
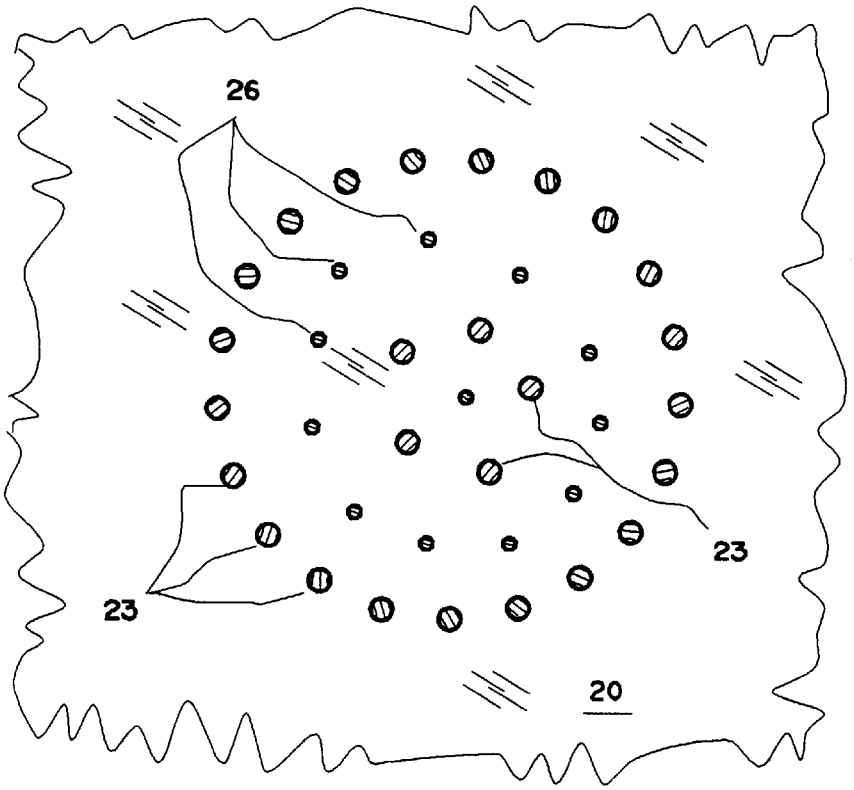
FIG. 5 is an enlarged sectional view of a single tuft of bristles of the toothbrush of FIG. 4 taken in the direction of the arrows upon the line 5—5.

Referring now to FIGS. 1–5, an embodiment of the toothbrush 10 of the present invention is shown comprised of an elongated handle 11 extending between a brushing end 12 and holding end 13, and a brush head 14 disposed upon said brushing end 12.

Handle 11 is comprised of a contoured rigid gripping portion 15 extending upwardly from holding end 13 toward brush head 14, and a narrowed resilient neck portion 18 extending between said gripping portion 15 and brush head 14. Handle 11 is preferably a monolithic structure molded from a flexible thermoplastic polymer such as polyurethane, plasticized polyvinyl chloride, and product SM1300 available from the Dow Plastics Co., of Midland, Mich. Gripping portion 15 may be provided with protruding features 16 which prevent slipping in the user's hand, and further provided with a recess 17 for thumb placement.

Gripping portion 15 may have a thickness of 13 to 18 millimeters at its site of greatest thickness. Neck portion 18 has a contour which tapers to gradually diminished thickness in proceeding from gripping portion 15 toward brush head 14. At its site of minimal thickness, adjacent said brush head, the thickness of the neck portion is preferably between about 4 and 6 millimeters. The resiliency of the neck portion may be characterized in terms of bending modulus. The preferred bending modulus is such that a force of one pound applied to brushing end 12 produces a deflection of said brush head between 3 and 8 millimeters, said deflection being produced by flexural movement in said neck portion.

Brush head 14 is comprised of a flat support surface 20 that secures bristles arranged in a plurality of tufts 21. The number of tufts may range between about 35 and 40. The tufts are preferably symmetrically located with respect to a vertical plane of symmetry 22 that longitudinally bisects the toothbrush. The separation between contiguous tufts is preferably between about 0.5 and 2 millimeters.

Each tuft is comprised of a multiplicity of primary bristles 23 of equal length and uniform cross-sectional configuration, as having been produced by an extrusion operation. Said primary 15 bristles have proximal ends 24 which are embedded in said brush head, and distal ends 25 extending orthogonally outward from support surface 20 and terminating in a plane 30 parallel to support surface 20. The length of said primary bristles extending above surface 20 may range from about 8 to 12 millimeters, and their distal ends are preferably rounded.

Also included within each tuft 21 is a multiplicity of secondary bristles 26 having proximal extremities 27 embedded in said brush head, and pointed distal extremities 28 extending orthogonally outward from said support surface to an action zone 29 located beyond the distal ends of said primary bristles. Said action zone extends between 2 and 4 millimeters above plane 30. Within said action zone, said secondary bristles have a tapered cross-sectional configuration that terminates in said pointed distal extremity.

Within each tuft there may be, for example, about 21 primary bristles and 17 secondary bristles. The general ratio of primary to secondary bristles is preferably in the range of 1.1 to 1.4. If too many secondary bristles are employed, their penetrative ability will be diminished, and they will function more like the primary bristles. It has been found that, in order to achieve acceptable stiffness of the bristles without causing gum irritation, all bristles should be fabricated of polybutylene terephthalate. It has also been found preferable that the secondary bristles be of thinner cross-sectional contour than the cross-sectional contour of the primary bristles.

In the operation of the toothbrush of this invention, the secondary bristles in the action zone enter crevices between the teeth and thereby function in the manner of a flossing treatment. With somewhat greater pressure applied by the user, the distal ends of the primary bristles contact the outer surfaces of the teeth to provide a polishing action.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A toothbrush comprising an elongated resilient handle extending between two ends and a brush head disposed at one of said ends, said brush head having a flat support surface and a plurality of tufts of bristles fabricated of polybutylene terephthalate, each tuft comprised of:

a) a multiplicity of primary bristles of uniform cross-sectional configuration having proximal ends embedded in said head and distal ends extending orthogonally outward from said support surface, and b) a multiplicity of secondary bristles having proximal extremities embedded in said head and pointed distal extremities extending orthogonally outward from said support surface to an action zone beyond the distal ends of said primary bristles, said secondary bristles having a tapered cross-sectional configuration in said action zone that terminates in said pointed distal extremity.

2. The toothbrush of claim 1 wherein one end of said toothbrush is a brushing end having said brush head disposed thereupon, and the other end of said toothbrush is a holding end.

3. The toothbrush of claim 2 wherein said handle is comprised of a contoured rigid gripping portion extending upwardly from said holding end toward said brush head, and a narrowed resilient neck portion extending between said gripping portion and brush head.

4. The toothbrush of claim 3 wherein said handle is a monolithic structure molded from a flexible thermoplastic polymer.

5. The toothbrush of claim 4 wherein said gripping portion is provided with protruding features which prevent slipping in the user's hand, and further provided with a recess for thumb placement.

6. The toothbrush of claim 3 wherein the resiliency of said neck portion is characterized as having a bending modulus such that a force of one pound applied to said brushing end produces a deflection of said brush head between 3 and 8 millimeters, said deflection being produced by flexural movement in said neck portion.

7. The toothbrush of claim 1 wherein the number of said tufts is between 35 and 40.

8. The toothbrush of claim 7 having a vertical plane of symmetry that longitudinally bisects the toothbrush.

9. The toothbrush of claim 8 wherein said tufts are symmetrically located with respect to said plane of symmetry.

10. The toothbrush of claim 9 wherein the distance of separation between contiguous tufts is between 0.5 and 2 millimeters.

11. The toothbrush of claim 1 wherein the primary bristles of each tuft are of equal length, thereby disposing their distal ends in a plane parallel to said flat support surface.

12. The toothbrush of claim 11 wherein the length of said primary bristles extending above said support surface is between 8 and 12 millimeters.

13. The toothbrush of claim 12 wherein the distal ends of said primary bristles are rounded.

14. The toothbrush of claim 11 wherein said action zone extends between 2 and 4 millimeters above the plane which contains the distal ends of said primary bristles.

15. The toothbrush of claim 1 wherein the ratio of primary to secondary bristles within each tuft is between 1.1 and 1.4.

16. The toothbrush of claim 15 wherein the secondary bristles are of thinner cross-sectional contour than the cross-sectional contour of said primary bristles.

* * * * *